United States Patent [19]

Portat et al.

[11] Patent Number: 5,044,514

[45] Date of Patent: Sep. 3, 1991

[54] CASK FOR THE TRANSPORT AND STORAGE OF CHEMICAL PRODUCTS

[75] Inventors: Philippe Portat, Chalon sur Saone; Michel Gourat, Chatenoy le Royal, both of France

[73] Assignee: Campagnie Plastic Omnium, Lyons, France

[21] Appl. No.: 565,201

[22] Filed: Aug. 8, 1990

Related U.S. Application Data

[60] Continuation of Ser. No. 316,876, Feb. 28, 1989 abandoned.

[30] Foreign Application Priority Data

Mar. 1, 1988 [FR] France ..... 88 02541

[51] Int. Cl.[5] ..... B65D 90/04

[52] U.S. Cl. ..... 220/411; 220/413; 220/466; 220/4.07

[58] Field of Search ..... 220/411, 413, 4 B, 4 C, 220/4 D, 5 R, 466, 469

[56] References Cited

U.S. PATENT DOCUMENTS

| | | | |
|---|---|---|---|
| 1,148,059 | 7/1915 | Steel | 220/466 X |
| 3,219,230 | 11/1965 | Housz et al. | 220/466 X |
| 3,730,374 | 5/1973 | Picciano et al. | 220/411 X |
| 3,938,687 | 2/1976 | Maier et al. | 220/5 R |
| 3,939,967 | 2/1976 | Tenney et al. | 220/4 B X |
| 3,977,569 | 8/1976 | Scholle | 222/105 |
| 4,071,160 | 1/1978 | Vick | 220/5 R |
| 4,280,640 | 7/1981 | Daloisio | 222/561 |
| 4,300,612 | 11/1981 | Schroeder, Jr. et al. | 220/4 B X |
| 4,793,491 | 12/1988 | Wolf et al. | 220/466 X |

FOREIGN PATENT DOCUMENTS

| | | | |
|---|---|---|---|
| 682486 | 5/1966 | Belgium | 220/4 B |
| 00121073 | 10/1984 | European Pat. Off. . | |
| 820959 | 11/1937 | France | 220/5 R |
| 2023089 | 12/1979 | United Kingdom | 220/5 R |

OTHER PUBLICATIONS

"Modern Packaging", vol. 41, No. 1, Jan. 1968, pp. 108-110, Space-Age Shipper Molded in Orbit.

*Primary Examiner*—Joseph Man-Fu Moy
*Attorney, Agent, or Firm*—Schweitzer Cornman & Gross

[57] ABSTRACT

A cask for the transport and storage of chemical products, including an interior shell made of fluorinated plastic material, in particular PFA, and an exterior shell presenting a substantially cylindrical exterior shape, and an interior shape substantially matching the interior shell, said exterior shell being constituted by two shell elements joined in a separable manner, characterized by the fact that the exterior shell is constituted by two superposed elements, nested, substantially circular in cross-section, joined by a screw connection.

4 Claims, 3 Drawing Sheets

CASK FOR THE TRANSPORT AND STORAGE OF CHEMICAL PRODUCTS

The present invention relates to a cask for the transport and storage of chemical products, particularly chemical products of very high purity such as those intended for the semiconductor industry.

Casks have been developed recently that are usable for this purpose. They include an interior shell made of a fluorinated plastic material, particularly PFA (perfluoroalkoxy copolymer), and an outer shell, which has a substantially cylindrical exterior shape and an interior shape substantially matching that of the interior shell.

It has already been proposed to make the exterior shell of plastic material, particularly polyethylene, this exterior shell furthermore being made by assembling two half-shells which have a semicircular cross-section and are joined along a vertical plane, the two half-shells being held together by straps or the like.

The presence of a vertical junction plane in the exterior shell presents the disadvantage that in case of a leak in the interior shell or its stopper device, the products contained may escape to the exterior.

The purpose of the present invention is to provide a cask which, while presenting an exterior shell constituted of two detachable parts, avoid the disadvantages of prior casks.

The cask according to the invention is characterized essentially by the fact that the outer shell is constituted of two superposed elements, an upper element and a lower element, which are nested, are substantially circular in cross-section, and are joined by a screw connection.

Preferably the lower element of the exterior shell includes at its upper end and annular flange having an interior cylindrical surface which is provided with threading. The latter threading is able to cooperate with threading provided on an exterior cylindrical surface of an annular flange formed at the lower end of the upper element of the exterior shell.

In a preferred embodiment of the invention the interior shell is formed from PFA by rotary molding. The exterior shell is preferably a double walled shell made of polyethylene padded with a polyethylene foam.

In order to make the invention more understandable, a non-limiting example of an embodiment thereof will now be described, with reference to the attached drawings, in which.

Figure 1:
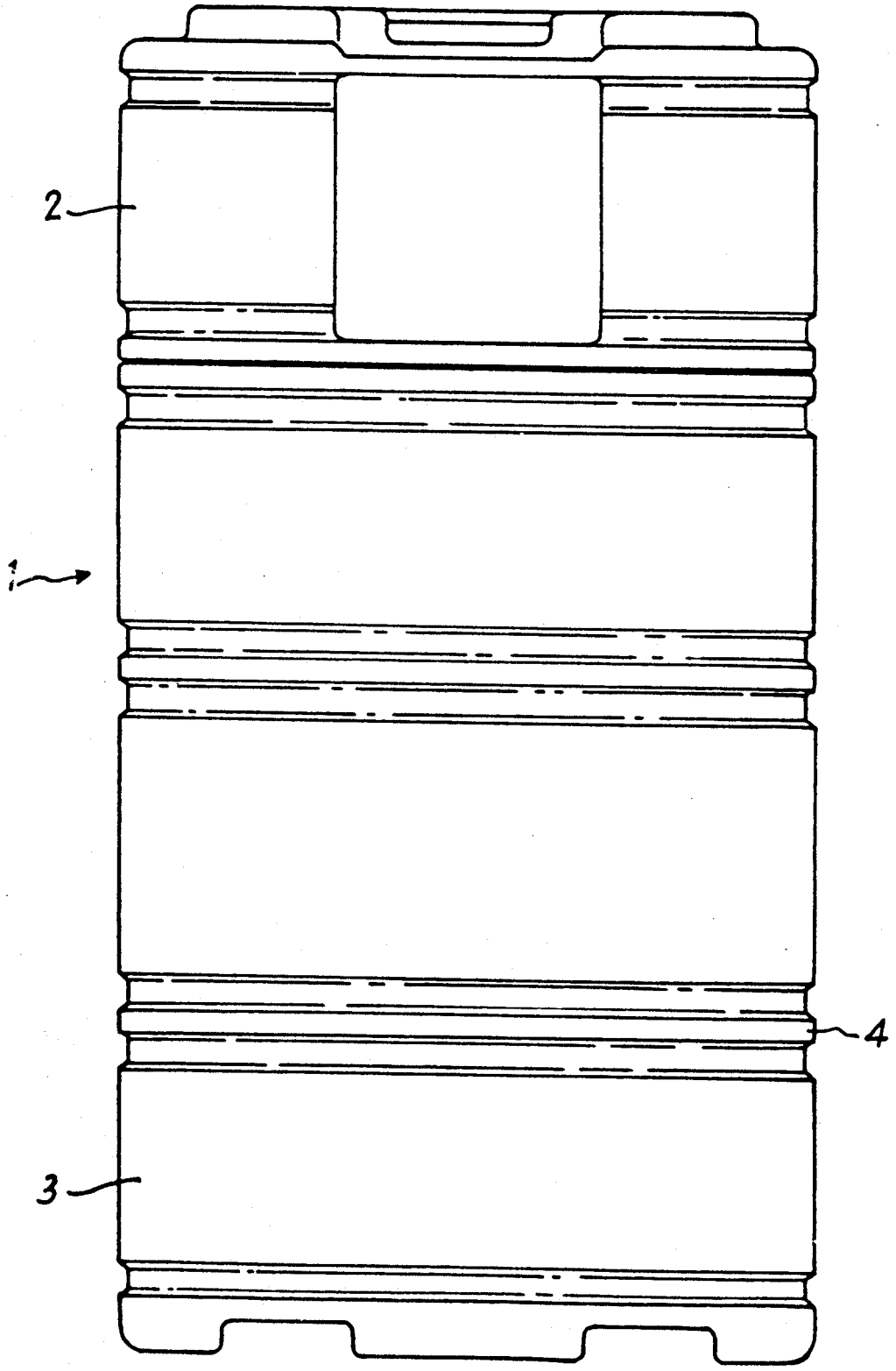
FIG. 1 is an elevational view of the cask according to the invention.

The cask according to the invention includes an exterior shell generally designated 1, including an upper element 2 and a lower element 3, the two elements 2 and 3 presenting a generally cylindrical shape, with a circular cross-section, and including an exterior wall provided with horizontal rigidifying ribs 4.

The upper element 2 includes, projecting from its lower part, an annular flange 5 provided with an exterior threading 6; and the lower element 3 of the exterior wall includes, projecting from its upper end, an annular flange 7 provided with an interior threading 8.

The threadings 6 and 8 formed on the cylindrical walls facing the flanges 5 and 7 permit the elements 2 and 3 constituting the exterior shell to be assembled by a screw connection.

Figure 2:
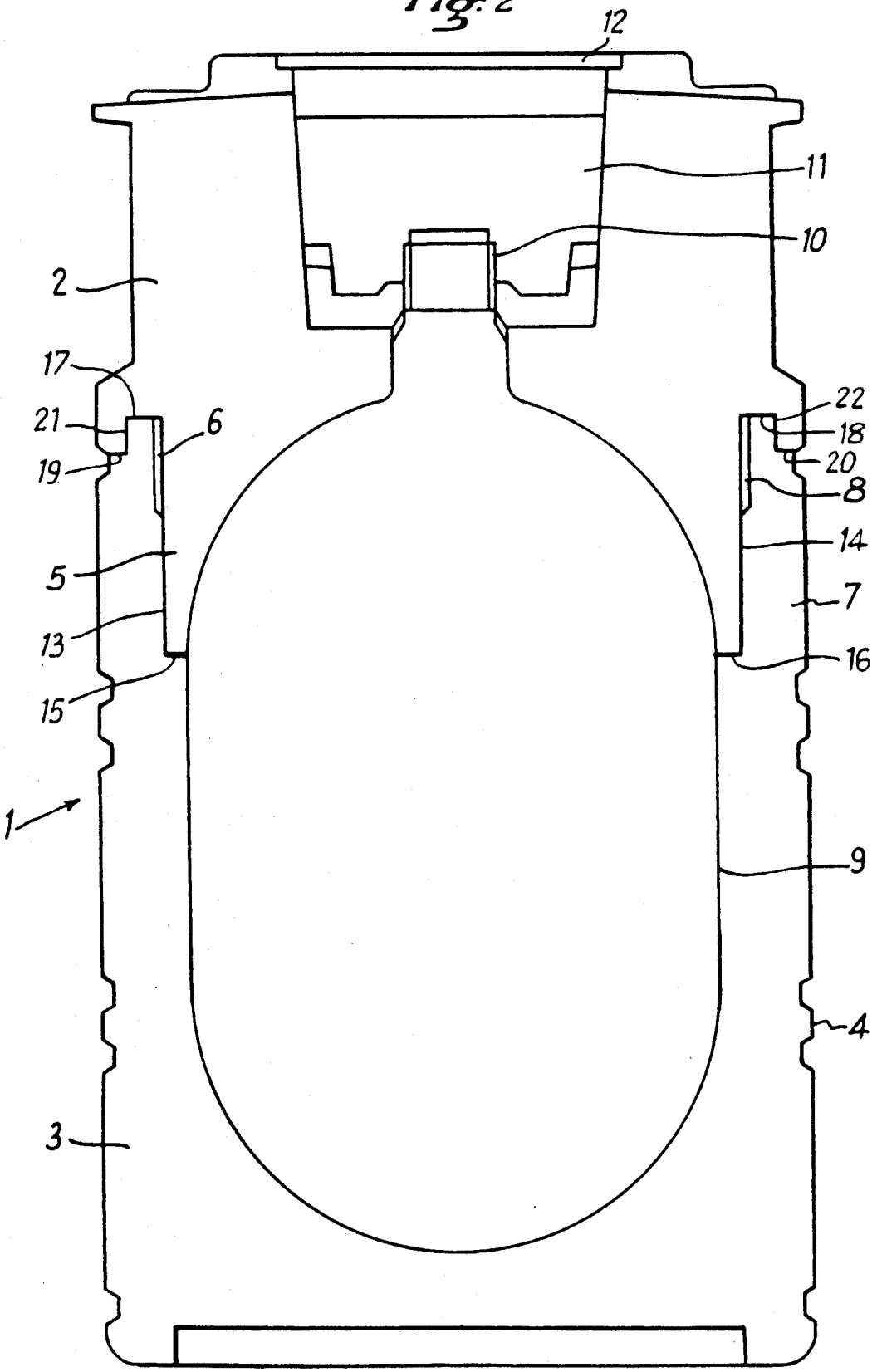
FIG. 2 is an axial cross-section.
Figure 3:
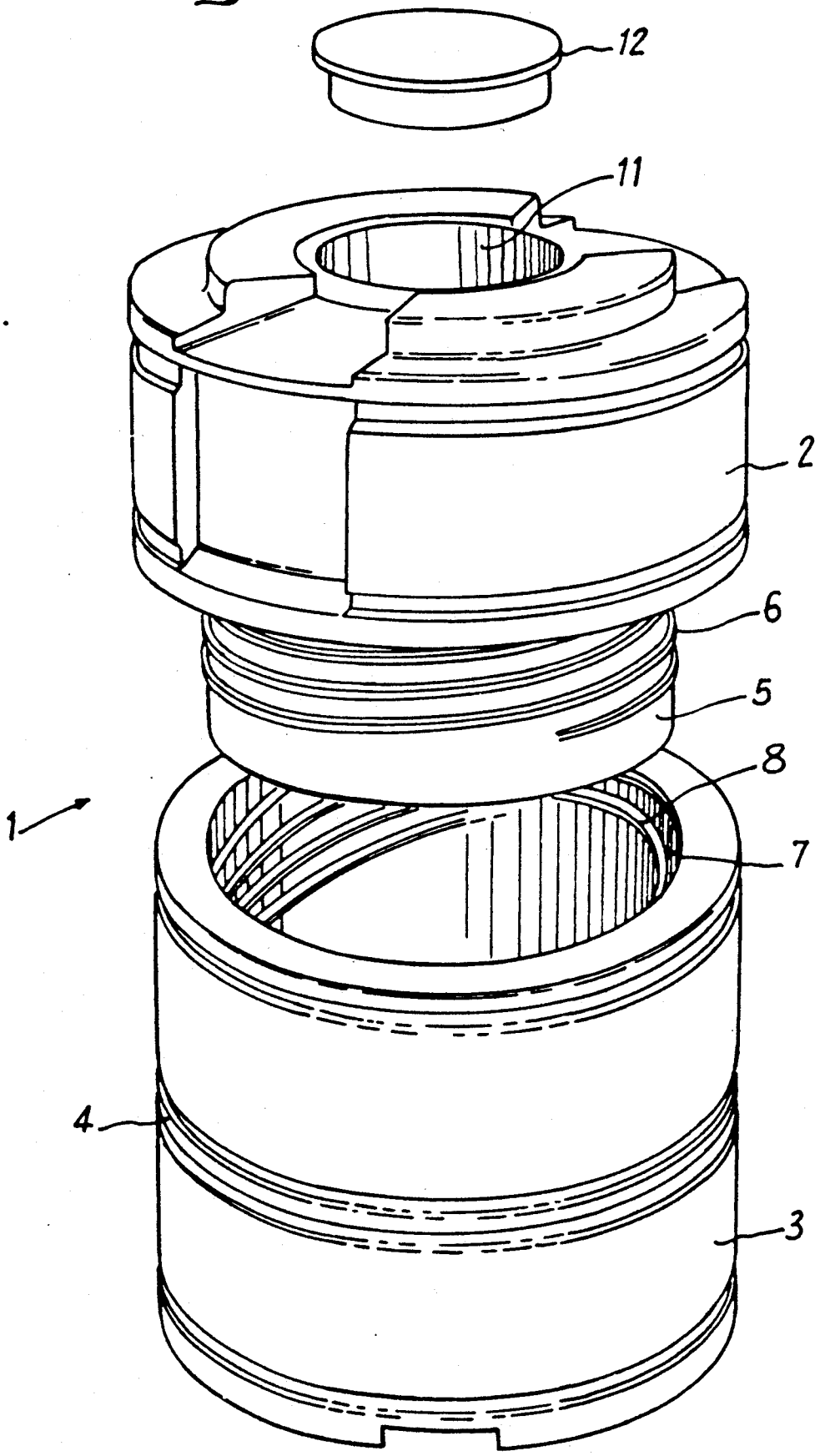
FIG. 3 is an exploded view illustrating schematically the exterior shell in a disassembled condition.

As seen in particular in FIG. 2, the elements 2 and 3 present an interior wall matching the shape of an interior shell 9 made of rotary-molded PFA, provided at its upper part with a stopper device 10, the upper element 2 of the exterior shell including a recess 11 for access to the stopper device 10, this recess being closable by a plug 12.

In addition, the elements 2, 3 of the exterior shell are in mutual contact, not only along the facing cylindrical walls 13 and 14, respectively, in which the threadings 6 and 8 are formed; but also along flat, axially staggered surfaces, perpendicular to the generatrices of the cask, and formed between the threadings 6, 8 and the exterior and interior surfaces, respectively, of the exterior shell 2, 3. Thus, at the lower end of the walls 13 and 14, the elements 2 and 3 of the exterior shell are in mutual contact along second and fifth annular surfaces 15, 16; and at the upper end of the walls 13, 14, along surfaces 17, 18 and third and sixth annular surfaces 19, 20, respectively as shown clearly in FIG. 2. The surfaces 17, 19 and 18, 20, respectively, are staggered in height and separated by cylindrical surfaces 21 and 22, which are in mutual contact.

These various annular and cylindrical surfaces give the contact surface between the elements 2, 3, on both sides of the threads 6, 8, a complex configuration which provides, within the thickness of the exterior shell, a labyrinthine path for any product which might accidentally escape, following an injury to the interior shell 9.

It will be understood that, owing to the invention, an exterior shell has been formed that is easily detachable, while also assuring excellent liquid-tightness. In case of a possible leak, particularly in the stopper device, or the wall of the interior shell, the products remain contained within the interior of the lower element 3 of the exterior shell without being able to escape toward the exterior, as was possible previously.

Although the invention has been described in connection with a particular embodiment thereof, in is in no way limited thereto, and numerous variations and modifications can be made without departing from either its scope or its spirit.

We claim:

1. A liquid-tight cask for the transport and storage of chemical products, including (a) an interior liquid-retaining shell or predetermined shape made of perfluoroalkyoxy copolymer material;

(b) an exterior double-walled shell having a generally cylindrical external configuration and an internal shape similar to that of the interior shell;

(c) said exterior shell comprising superposed upper and lower elements nested and joined in a separable, liquid-tight manner;

(d) said lower exterior shell element being substantially circular in cross-section and having an annular first flat surface at its uppermost end and having internal thread means formed on cylindrical internal surfaces;

(e) said lower exterior shell having an annular second flat surface disposed below said thread means along an inner surface of said exterior shell;

(f) said lower exterior shell having an annular third flat surface disposed below said first annular surface along an outer surface of said lower exterior shell;

(g) said upper element being substantially circular in cross-section and having a depending cylindrical flange having external threads adapted to threadingly engage said internal threads;

(h) said upper element further including staggered fourth, fifth and sixth annular flat surfaces at its lower end adapted to contact said first, second and third annular flat surfaces of said lower element when said internal and external threads are engaged, thereby forming an impermeable labyrinthine relation when said upper and lower elements are fully threaded together.

2. A cask in accordance with claim 1, further characterized in that (a) said flat annular surfaces are parallel to one another and are perpendicular to the generatrices of the cask.

3. A cask in accordance with claim 1 further characterized in that (a) said exterior shell elements are made of polyethylene foam.

4. A cask in accordance with claim 1, further characterized in that (a) said upper exterior shell element has an opening formed therein;

(b) uppermost portions of said interior shell project through said opening; and (c) a removable, liquid-tight cap means closing said opening is included in said upper exterior shell.

* * * * *